US010890029B2

(12) United States Patent
Simon

(10) Patent No.: US 10,890,029 B2
(45) Date of Patent: Jan. 12, 2021

(54) FALL ARREST LADDER SYSTEM

(71) Applicant: Simone Simon, Jamaica, NY (US)

(72) Inventor: Simone Simon, Jamaica, NY (US)

( * ) Notice: Subject to any disclaimer, the term of this patent is extended or adjusted under 35 U.S.C. 154(b) by 0 days.

(21) Appl. No.: 16/569,861

(22) Filed: Sep. 13, 2019

(65) Prior Publication Data

US 2020/0080377 A1 Mar. 12, 2020

Related U.S. Application Data

(63) Continuation-in-part of application No. 15/705,305, filed on Sep. 15, 2017, now abandoned.

(51) Int. Cl.

| | |
|---|---|
| ***E06C 7/18*** | (2006.01) |
| ***E06C 7/46*** | (2006.01) |
| ***E06C 7/48*** | (2006.01) |
| ***A62B 35/00*** | (2006.01) |

(52) U.S. Cl.

CPC ..... *E06C 7/18* (2013.01); *A62B 35/0006* (2013.01); *A62B 35/0093* (2013.01); *E06C 7/46* (2013.01); *E06C 7/48* (2013.01)

(58) Field of Classification Search

CPC . E06C 7/18; E06C 7/182; E06C 7/183; E06C 7/186; E06C 7/187

USPC ..... 182/8, 231–234

See application file for complete search history.

(56) References Cited

U.S. PATENT DOCUMENTS 3,598,200 A * 8/1971 Thompson ..... E06C 7/186 182/8
3,908,791 A * 9/1975 Kleine ..... A62B 1/14 182/8
4,193,475 A * 3/1980 Sweet ..... A62B 35/0062 182/8
4,709,783 A * 12/1987 Tomioka ..... A62B 1/00 182/198
4,877,110 A * 10/1989 Wolner ..... A62B 35/0093 182/232
5,265,696 A * 11/1993 Casebolt ..... A62B 1/14 182/192
5,316,102 A * 5/1994 Bell ..... E04G 21/3261 182/3
5,964,316 A * 10/1999 Roy ..... A62B 35/0068 182/3
6,161,647 A * 12/2000 Braden ..... A62B 1/14 182/5
D578,867 S * 10/2008 Deuer ..... D8/354
8,875,839 B1 * 11/2014 Licea ..... A62B 35/005 182/5

(Continued)

*Primary Examiner* — Joshua E Rodden

(74) *Attorney, Agent, or Firm* — The Rapacke Law Group P.A.

(57) ABSTRACT

A fall arrest ladder system including a housing assembly having a retractable lanyard, braking system, safety line, and webbing belt is disclosed. The fall arrest system allows for the safe deceleration of the user from an elevated position on a ladder to prevent the user from making harmful contact with the ground. The safety line and retractable lanyard are each attached to a ladder and then attached to the webbing belt worn by the user, permitting the user to freely move along the length of the ladder while remaining tethered securely in the event of a slip or fall from the ladder. The safety line prevents the user from falling away from the ladder while the retractable lanyard and incorporated braking system decelerate the user during a downward fall.

19 Claims, 5 Drawing Sheets

(56) References Cited

U.S. PATENT DOCUMENTS 9,010,487 B2 * 4/2015 Cruz ..... E04G 21/3276 182/3
9,784,034 B2 * 10/2017 Short ..... A62B 35/0075
2002/0014370 A1 * 2/2002 Casebolt ..... A62B 1/14 182/5
2006/0086567 A1 * 4/2006 Deuer ..... A62B 1/16 182/8
2007/0045045 A1 * 3/2007 Deuer ..... F03D 80/00 182/8
2007/0256892 A1 * 11/2007 Breedlove, Sr. ..... E06C 1/381 182/116
2010/0038172 A1 * 2/2010 Ralston ..... E06C 7/46 182/107
2010/0326768 A1 * 12/2010 Kerstetter, Jr. ..... E06C 7/48 182/5
2012/0080263 A1 * 4/2012 Lee ..... E06C 1/345 182/8
2013/0048421 A1 * 2/2013 Midtgaard ..... E06C 7/187 182/8
2013/0095968 A1 * 4/2013 Stephenson ..... B66D 1/7405 474/137
2013/0319793 A1 * 12/2013 Stibilj ..... A62B 35/0012 182/3
2015/0075907 A1 * 3/2015 Moss ..... E06O 1/36 182/129
2015/0217150 A1 * 8/2015 Harris ..... A01M 31/02 182/5
2015/0218868 A1 * 8/2015 Olesen ..... E04H 12/00 49/356
2015/0273250 A1 * 10/2015 Bina ..... B66B 9/187 182/8
2015/0275580 A1 * 10/2015 Canfield ..... E06C 7/186 182/8
2016/0047167 A1 * 2/2016 Shuch ..... E06C 7/186 182/8
2016/0222729 A1 * 8/2016 Shih ..... E06C 7/182
2018/0160780 A1 * 6/2018 Huang ..... A45F 5/00
2019/0143158 A1 * 5/2019 Zimmerman ..... A62B 1/10 182/231
2020/0080377 A1 * 3/2020 Simon ..... A62B 35/0006

* cited by examiner

FALL ARREST LADDER SYSTEM

This application is a continuation-in-part to U.S. Non-Provisional application Ser. No. 15/705,305 entitled "Safe Ladder-Safety Ladder Harness" and filed Sep. 15, 2017, which is hereby incorporated by reference in its entirety.

TECHNICAL FIELD

The embodiments generally relate to fall arrest systems and more specifically relates to fall arrest systems for use in fall hazard environments.

BACKGROUND

Any time a person is suspended at some point above ground, they face the risk of injury due to fall should their position be compromised in some manner. Construction workers and other manual laborers are routinely in situations where they must be positioned off the ground in order to perform their job. This often requires that they climb a ladder to reach or access areas located higher up than can be reached when standing on the ground. Likewise, most homes have some form of a ladder for its occupants to climb when needing to reach high up places, such as when changing a lightbulb or accessing the roof. In either case, the person using the ladder may climb a significant distance off the ground in order to reach their desired position, during which they face the risk of injury due to fall which, even when only a few feet off the ground, can be catastrophic or fatal.

Fall arresters are frequently used to prevent the freefall of a person off of an elevated surface or climbing apparatus such as a ladder. One of the most common examples of a fall arrest system would be the carabiner and rope system used by rock climbers to prevent fall should a hand or foothold slip or give way. Because up to ten percent of workplace injuries and fatalities occur from the worker being on elevated surfaces, The Occupational Safety and Health Administration (OSHA) now requires the use of fall protection systems such as a fall arrester for any labor in which the worker is susceptible to a fall of six or more feet. Consequently, the use of fall arresters has become the norm for safety measures taken by construction workers, roofers or other blue-collar workers using a ladder.

Various types of fall arrest systems for ladders currently exist but are not typically a one-size-fits-all model. Rather they are typically designed for a specific type of ladder, user, or calibrated for use at specific heights. This requires construction workers and companies of all sorts to purchase multiple forms of fall arresters, and results in household consumers being unable to adequately secure fall protection for everyday use. The capability for a fall arrester to have universal compatibility with all ladders for a variety of users at varying heights would serve an immense financial benefit to construction companies, workers, and household consumers. A universal fit ladder fall protection system would also, likely, increase the overall safety on a worksite as it only requires the knowledge of one system's use and installation rather than that of multiple different types of systems for each ladder or scenario, thus minimizing room for error and maximizing safety.

Relevant fall arresters typically are comprised of a rope, cable, or steel bar connected with an anchor, in addition to various clips and carabiners that attach elements of the system such as a harness or belt to the anchor. Presently, a majority of the OSHA compliant safety fall arrest systems are designed for use by a model construction worker; however, the average consumer is not a model, and further safety precautions should be considered. For example, ropes or steel bars do not prove to be as strong or stable for heavier users. A steel cable would provide stronger enforcement capable of withstanding the deadweight of heavier falls, as well as providing more flexibility and stability than just a stiff, steel bar or weak, erodible rope. Further, steel cables are also more durable than ropes in instances of inclement weather as a rope is extremely vulnerable to the elements, degrading over short periods of time.

SUMMARY OF THE INVENTION

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

The system includes a housing having at least a mounted eye bolt, a D-Ring bolt assembly configured to secure a safety line to the eye bolt assembly, a screw lock configured to secure the retractable lanyard housing to the mounted eye bolt, an adjustable webbing belt including an anchor ring and an industrial grade snap lock carabiner, and a safety configured to be releasably secured a first end to the housing assembly and the adjustable webbing belt at a second end.

The system is provided to allow a variety of users working in an elevated position to safely decelerate using a retractable lanyard and braking system in the event of a fall from an elevated position while minimizing stress to the user's body.

In one aspect, the system may be constructed of aluminum, steel, stainless steel, or a combination of light-weight alloys which are easily mountable to a variety of ladder systems.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
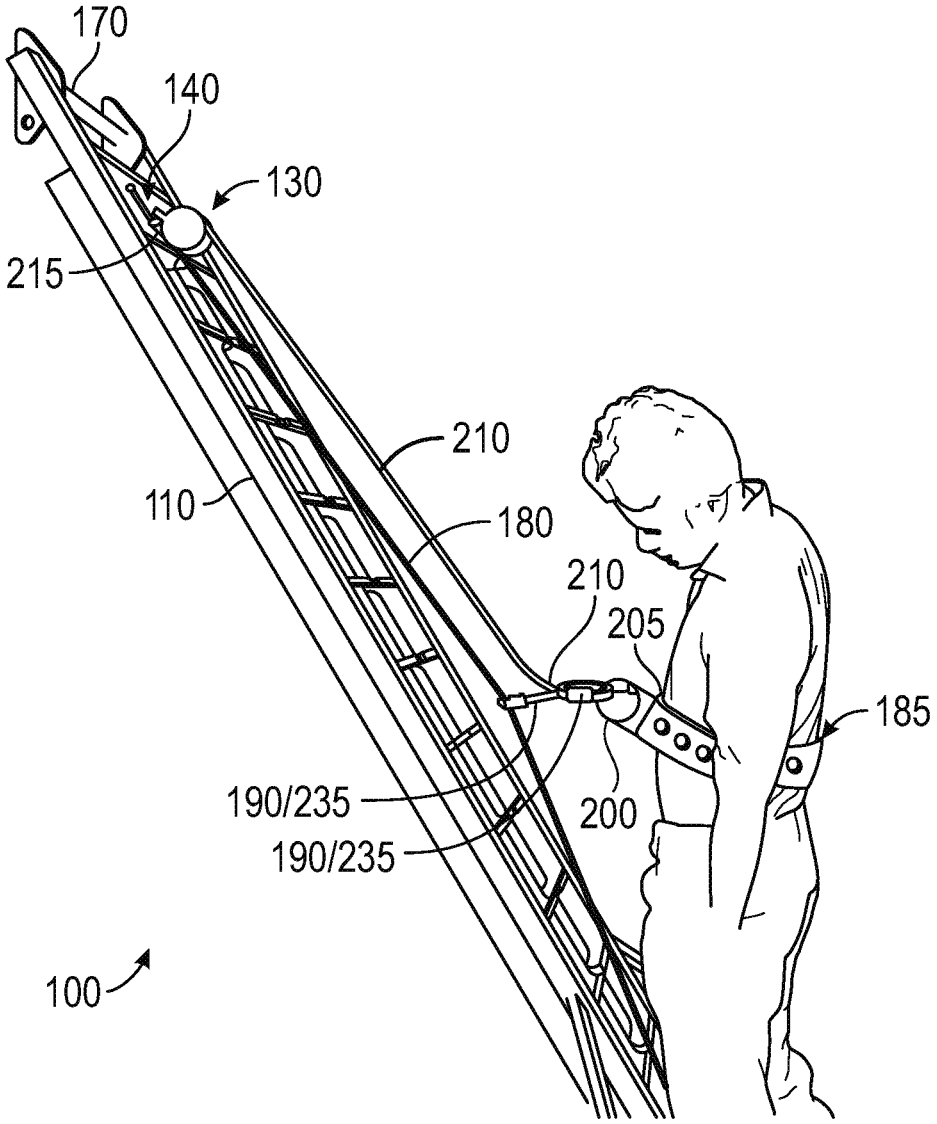
FIG. 1 illustrates a perspective view of the fall arrest ladder system, according to some embodiments.

The specific details of the single embodiment or variety of embodiments described herein are to the described system. Any specific details of the embodiments are used for demonstration purposes only, and no unnecessary limitations or inferences are to be understood therefrom.

Before describing in detail exemplary embodiments, it is noted that the embodiments reside primarily in combinations of components of the system. Accordingly, the system components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments provided herein relate to a fall arrest ladders system, which is containerized, allowing for a user's who has slipped from a ladder rung to be suspended by the system and avoid a catastrophic fall onto the ground surface.

Illustrated in FIG. 1 is a perspective view of the fall arrest ladder system 100 which creates slight tension when attached to the user and acts to decelerate the user in the event of a fall from an elevated position by locking the retractable lanyard 210 and arresting the user before impacting the ground surface or lower obstruction. The system 100 is configured to allow a user to be tethered to a ladder 110 using a retractable lanyard 210 encompassed with a housing assembly 130 to arrest the user in the event of a slip or fall from a ladder rung and be suspended in the air without falling directly on the ground.

The system 100 includes a housing assembly 130 including a retractable lanyard 210 configured to be attached to a ladder rung or clipped within the eye bolt assembly 140 at the first end of the safety line 180. During use, a safety line 180 is affixed at a top end and bottom end of the ladder 110 and further secured with at least one wall bracket 170 and braces 237 in a substantially tightened position when the ladder 110 is placed into an extended position. It is contemplated that the safety line 180 is comprised of a braided steel or stainless-steel material and further includes the eye bolt assembly 140 at the first end of the safety line 180 and at the second end of the safety line 180 and prevents the user from swinging into and striking any adjacent structures or ladder 110 when the retractable lanyard 210 is activated by increasing both horizontal and vertical mobility.

The user then firmly attaches a webbing belt 185 around their waistline and clips an industrial-strength screw lock carabiner 190 to the safety line 180 and into the anchor ring 200 located at the center of the webbing belt 205. Optionally, a second screw lock carabiner 190 can be clipped as in intermediate between the first screw lock carabiner 190 and the safety line 180, as shown in FIG. 1. The user may then attach a second end of the retractable lanyard 210 to the webbing belt at the anchor ring 200 and proceed to a desired height on the extended ladder 110. The housing assembly 130 is attached to the eye bolt assembly 140 using a screw lock 215. The retractable lanyard 210 allows for a predetermined freefall distance prior to activating and arresting the user while minimizing impact and stress to the user's body. Tension is maintained in the retractable lanyard 210 with a restoring spring and when a pre-selected activation speed is exceeded, the brake system is simultaneous activated and the retractable lanyard 210 is locked into place as a result of the centrifugal force.

Figure 2:
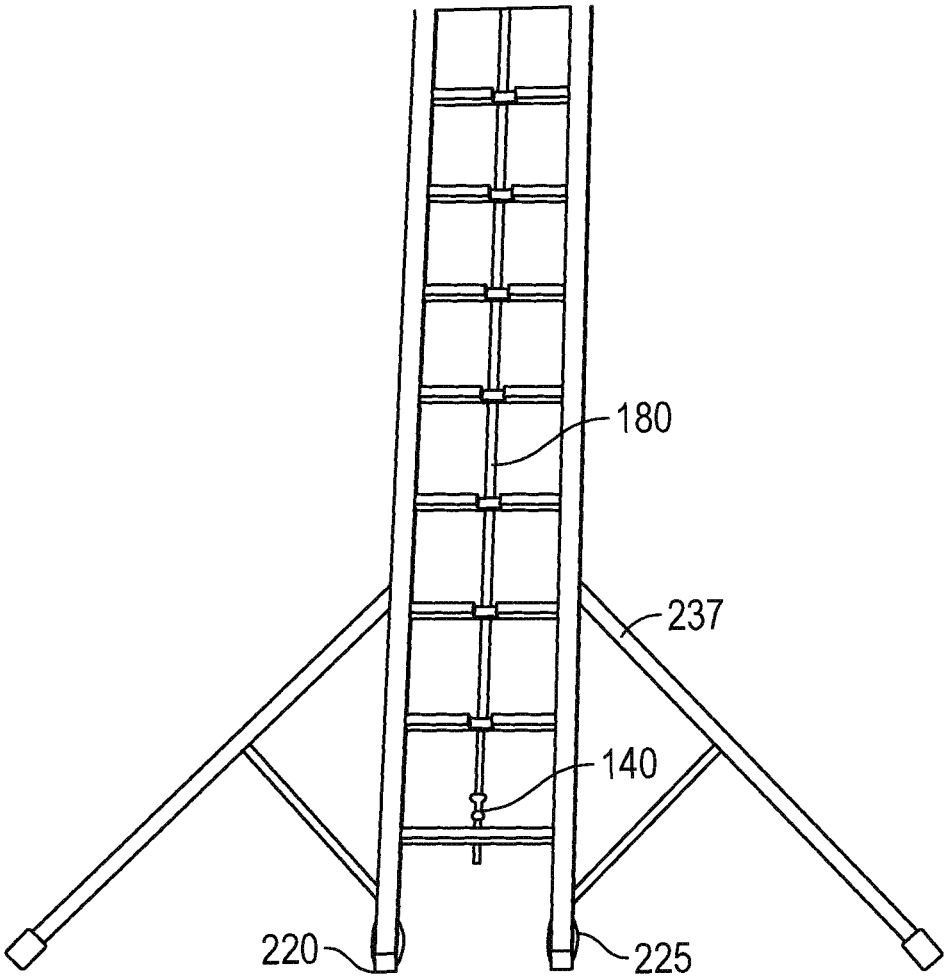
FIG. 2 illustrates a view of the ladder including a bottom brace, according to some embodiments.

FIG. 2 illustrates a view of the ladder 110 placed in an extended position with the safety line 180. It is further contemplated that the ladder 110 includes swivel shoes 220 to increase friction along the bottom of the ladder 225 while placed on smooth surfaces. Further illustrated in FIG. 2 is a set of braces 237, which enhance stability to the base of the ladder 110 when extended.

Figure 3:
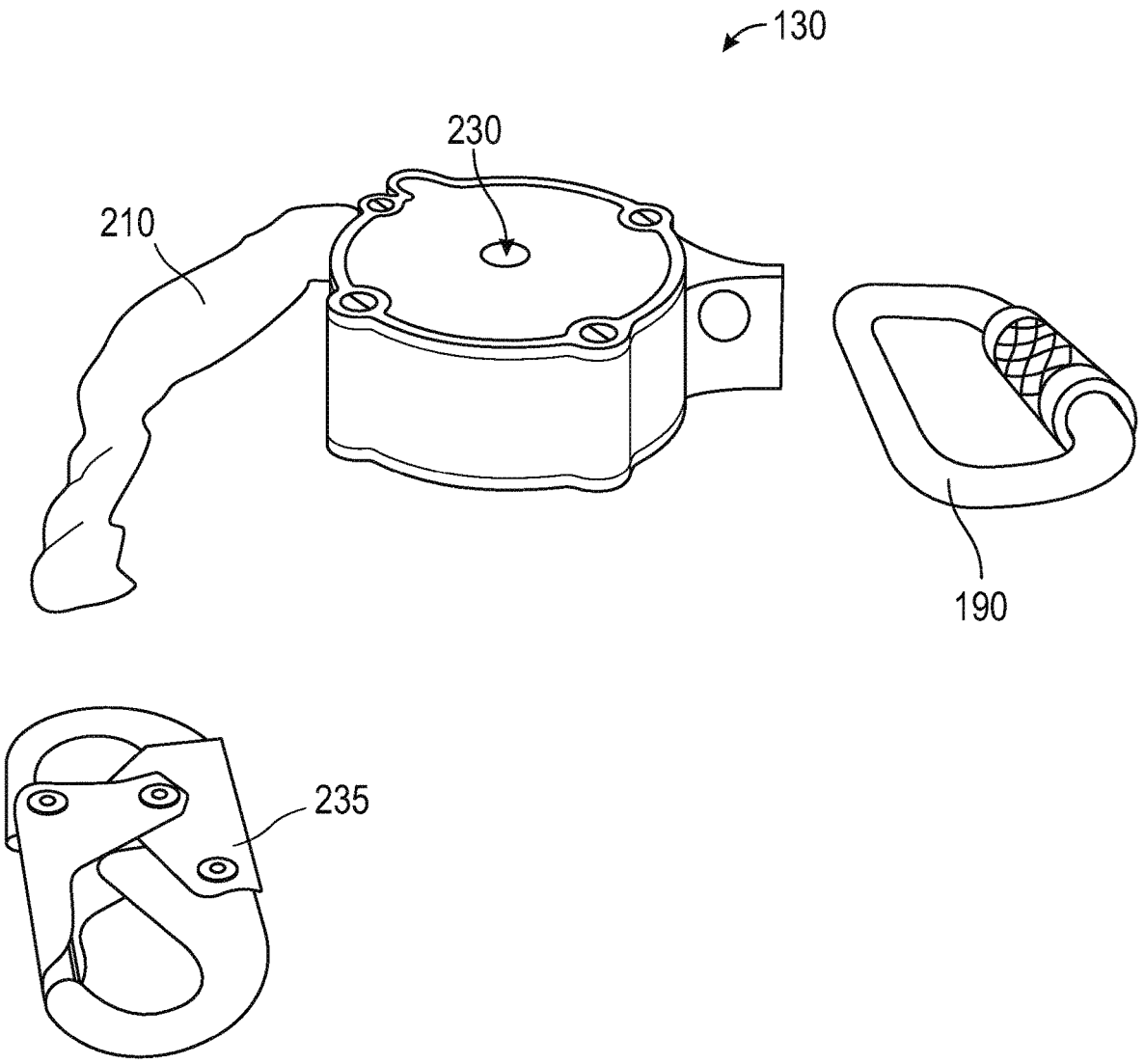
FIG. 3 illustrates a view of the housing assembly including the retractable lanyard, according to some embodiments.

FIG. 3 illustrates a view of the housing assembly 130 with the retractable lanyard 210 in the retracted position around the internal spool 230, which allows the user to work in a variety of elevated workspaces involving fall hazards including high building, chimney, bridges, and roofs while allowing the user the freedom of movement. Further illustrated is the industrial-strength screw lock carabiner 190 or alternative snap lock 235 which may be attached around the safety line 180.

Figure 4:
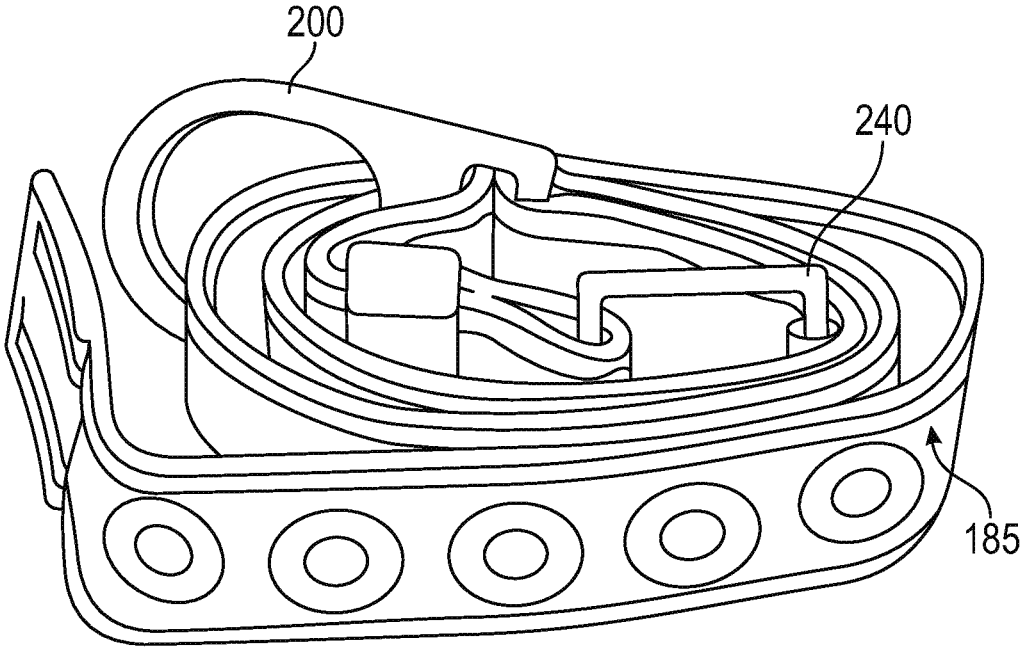
FIG. 4 illustrates a view of the adjustable webbing belt including the anchor ring, according to some embodiments.

FIG. 4 illustrates a view of the webbing belt 185 including the anchor ring 200. It is contemplated that the webbing belt 185 may be comprised of leather or a synthetic fiber such as nylon, polypropylene or polyester and adjusted around the waistline of the user at the buckle 240.

Figure 5:
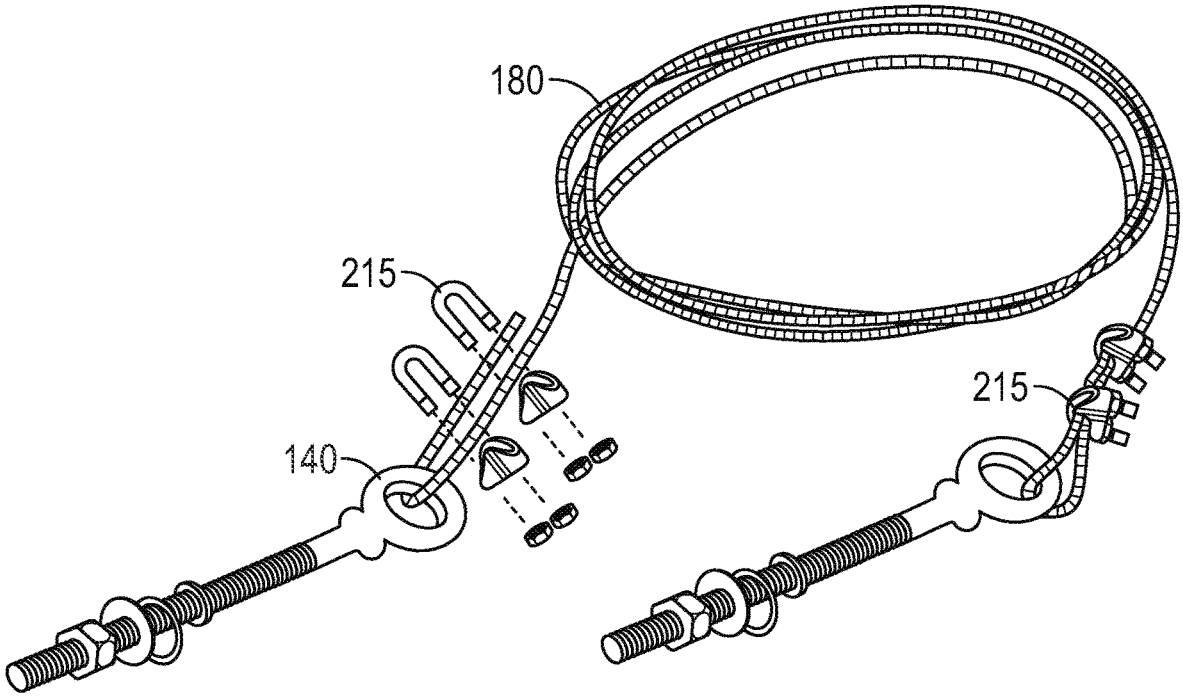
FIG. 5 illustrates a view of the safety line with attached eye bolt assembly, according to some embodiments.

FIG. 5 illustrates a view of the safety line 180 wrapped around the eye bolt assembly 140 and secured using at least one screw lock and two or more nuts 215.

It will be appreciated by persons skilled in the art that the present embodiment is not limited to what has been particularly shown and described hereinabove. A variety of modifications and variations are possible in light of the above teachings without departing from the following claims.

What is claimed is:

1. A fall arrest ladder system, comprising:

a housing assembly comprising a retractable lanyard, an internal spool for the retractable lanyard, and a braking system; wherein the housing assembly is configured to be mounted at a pre-determined height on a ladder rung;

a first eye bolt assembly, a second eyebolt assembly, and a safety line assembly comprising a cable safety line capable of decelerating a user in the event of a fall from an elevated position; wherein the first and second eyebolt assemblies are each mountable to ladder rung;

an adjustable webbing belt having an affixed anchor ring, wherein the belt is configured to be releasably secured to the user; and a releasably affixed carabiner configured to secure the webbing belt to the safety line at the anchor ring.

2. The system of claim 1, wherein the first eye bolt assembly is securable to a rung on an upper portion of the ladder and the second eyebolt assembly is securable to a rung on the lower portion of the ladder.

3. The system of claim 2, wherein each of the first eye bolt assembly and the second eye bolt assembly comprises a screw lock for secureably attaching the braided steel cable safety line thereto.

4. The system of claim 3, wherein during use of the system, the ladder is further secured with at least one wall bracket at or near the top of the ladder and braces positioned so as to enhance the stability of the ladder in a substantially tightened position when the ladder is placed into an extended position.

5. The system of claim 3, wherein each of the first eye bolt assembly and second eye bolt assembly comprises a second screw lock.

6. The system of claim 5, wherein the carabiner is dimensioned to secure about and traverse a length of the safety line as the user varies their position on the ladder.

7. The system of claim 1, wherein the adjustable webbing belt is configured to receive a releasably attachable carabiner.

8. A fall arrest ladder system, comprising:

a safety line assembly including a safety line, a first eye bolt assembly, and a second eyebolt assembly; wherein the safety line is releasably secured at a first end to the first eyebolt assembly and at a second end to the second eye bolt assembly, the safety line assembly configured to be releasably secured by the first eye bolt assembly to an upper rung of a ladder and by the second eye bolt assembly to a lower rung of the ladder;

an adjustable webbing belt, dimensioned to be releasably secured about the waist or torso of a user and configured to bear the weight of the user in an event of a fall from the ladder, including an affixed anchor ring to releasably secure the webbing belt to the safety line with a releasably affixed carabiner; and a housing assembly including a retractable lanyard with an internal spool and a braking system, wherein the housing assembly is configured to be mounted at a pre-determined height on a rung of the ladder or on the first eye bolt assembly to decelerate the user in the event of a fall from an elevated position.

9. The system of claim 8, further comprising a safety ladder including at least one wall bracket at a first end to secure the safety ladder to a vertical structure.

10. The system of claim 9, wherein the safety ladder further includes a plurality of swivel shoes at a second end to provide a secure base at a surface.

11. The system of claim 10, wherein the safety ladder further includes a left bottom brace and a right bottom brace to provide increased stability to the base of the ladder when deployed against the vertical structure.

12. The system of claim 8, wherein each of the first eye bolt assembly and second eye bolt assembly are secured to the safety line using a screw lock and one or more corresponding nuts.

13. The system of claim 8, wherein the safety line is comprised of braided steel cable.

14. The system of claim 8, wherein the carabiner is dimensioned to secure about and traverse a length of the safety line as the user varies their position on the ladder.

15. A fall arrest ladder system, comprising:

a safety ladder including at least one wall bracket at a first end to secure the safety ladder to a vertical structure and a plurality of swivel shoes at a second end to provide a secure base at a horizontal surface;

a safety line assembly including a safety line, a first eye bolt assembly, and a second eyebolt assembly, wherein the safety line is releasably secured at a first end to the first eyebolt assembly and at a second end to the second eye bolt assembly, wherein the safety line assembly is configured to be releasably secured by the first eye bolt assembly to an upper rung of the safety ladder and by the second eye bolt assembly to a lower rung of the safety ladder;

an adjustable webbing belt, dimensioned to be releasably secured about the waist or torso of a user and configured to bear the weight of the user in an event of a fall from the safety ladder, wherein the webbing belt includes an affixed anchor ring to releasably secure the webbing belt to the safety line with a releasably affixed carabiner; and a housing assembly configured to be mounted at a pre-determined height on the upper rung of the safety ladder or on the first eye bolt assembly, the housing assembly including a spool and a retractable lanyard and configured to be releasably secured to the anchor ring of the webbing belt.

16. The system of claim 15, wherein the safety ladder further includes a left bottom brace and a right bottom brace to provide increased stability to the base of the safety ladder when deployed against the vertical structure.

17. The system of claim 15, wherein each of the first eye bolt assembly and second eye bolt assembly includes a screw lock and a nut.

18. The system of claim 15, wherein the safety line is comprised of braided steel cable.

19. The system of claim 15, wherein the carabiner is dimensioned to secure about and traverse a length of the safety line as the user varies their position on the ladder.

* * * * *